United States Patent [19]

Miyata et al.

[11] 4,224,984

[45] Sep. 30, 1980

[54] FINNED TUBE USEFUL FOR HEAT EXCHANGERS

[75] Inventors: Etsutaro Miyata, Yamatokoriyama; Toshiya Tonomura, Nara, both of Japan

[73] Assignee: Sharp Kabushiki Kaisha, Osaka, Japan

[21] Appl. No.: 559,780

[22] Filed: Mar. 19, 1975

[30] Foreign Application Priority Data

| | | | |
|---|---|---|---|
| Mar. 20, 1974 | [JP] | Japan | 49-32237 |
| Apr. 30, 1974 | [JP] | Japan | 49-49878[U] |
| Feb. 4, 1975 | [JP] | Japan | 50-15043 |

[51] Int. Cl.[2] ..... F28D 7/02

[52] U.S. Cl. ..... 165/184; 29/157.3 AH

[58] Field of Search ..... 29/157.3 AH; 165/183, 165/184, 182

[56] References Cited

U.S. PATENT DOCUMENTS

| | | | |
|---|---|---|---|
| 891,698 | 5/1906 | Briscoe | 165/181 |
| 1,689,568 | 10/1928 | Wade | 165/184 X |
| 2,070,539 | 7/1937 | Muhleisen | 165/184 |
| 2,613,066 | 10/1952 | Newlin | 165/184 |
| 2,731,245 | 1/1956 | McChesney | 29/157.3 AH |
| 3,288,209 | 11/1966 | Wall et al. | 165/184 |
| 3,434,533 | 3/1969 | Pignal | 165/183 |

*Primary Examiner*—Samuel Scott
*Assistant Examiner*—Theophil W. Streule, Jr.
*Attorney, Agent, or Firm*—Birch, Stewart, Kolasch & Birch

[57] ABSTRACT

A length of a tubing is helically wound with a fin made of a heat-radiating strip and which is corrugated to provide a series of transverse crimps. A base is provided by flattening a portion of the crimps with the use of pressure rollers at one edge of the strip when the section of the fin is "L" shaped, or at the middle of the strip when the section of the fin is "U" shaped in order to cling closely to the tubing. The fin is bent at the boundary area between the flattened portion and the crimped portion when the fin is helically wound around the tubing.

8 Claims, 25 Drawing Figures

FIG. 5aaa

FINNED TUBE USEFUL FOR HEAT EXCHANGERS

BACKGROUND OF THE INVENTION

The present invention relates to a finned tube useful for heat exchangers and more particularly to a novel construction of a tubing helically wound with a crimped fin.

The present invention also relates to a method for fabricating a novel finned tube.

A number of types of finned tubing, a length of which is helically wound with a thin strip of heat-radiating material, are well known. The periphery of the fin must be stretched in order to wind the fin around the tubing with no crimps are provided. In this instance the tubing can not be a thin tubing since the tubing must tolerate the higher pressure which is caused during the winding operation. Thus, the periphery of the strip may be ruptured when the fin is substantially long.

To avoid the above-mentioned defects, a fin having a number of cuts was proposed in the U.S. Pat. No. 3,134,166, Herbert J. Venables III "MANUFACTURE OF HEAT EXCHANGE TUBING", issued on May 26, 1964. However, it was discovered that cuts may be undesirably bent or torn off and may considerably increase ventilating resistance.

It was proposed to provide transverse crimps on the strip in the U.S. Pat. No. 1,972,230, Edward G. Lehman "FINNED TUBE", issued on Sept. 4, 1934. However, the strip could not achieve close contact with the periphery of the tubing since only one edge of the strip, which is very thin, contacts the periphery of the tubing.

U.S. Pat. No. 2,532,239, John Shipley Newlin "FINNED TUBE WINDING MACHINE", issued on Nov. 28, 1950 suggested providing flutes along one edge of the strip and depress them against the periphery of the tubing during the winding operation in order to provide a base for making good contact with the tubing. In this instance the tubing must be thick since the flutes are flattened by depressing them against the tubing and the contacting area can not be selected without regard to the height of the fin.

OBJECTS AND SUMMARY OF THE INVENTION

Accordingly, an object of the present invention is to provide a finned tubed heat exchanger of high effectiveness by a simple method.

Another object of the present invention is to provide a finned tubing which can desirably select the contacting area between the fin and the periphery of the tubing without regard to the height of the fin and the amplitude of the crimps provided on the fin.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, pursuant to the present invention, there are provided a series of transverse crimps on a fin made of a heat-radiating strip. The base is provided by flattening a portion of the crimps with the use of pressure rollers at one edge of the strip when the section of the fin is "L" shaped, or at the middle of the strip when the section of the fin is "U" shaped in order to make good contact with the periphery of the tubing. The fin is bent at the boundary area between the flattened portion and the crimped portion before the fin is helically wound around the tubing.

The wave length of the crimps at the periphery of the fin is longer when compared with that of the central portion of the fin, and the amplitude of the crimps at the periphery of the fin is smaller when the fin is helically wound around the tubing. The change in the wave length and the amplitude of the crimps will make the winding operation easy. The winding operation can be accomplished under relatively low pressure because there is no necessity for changing the thickness of the fin. Therefore, the fin of the present invention can be applied to a thin tubing.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 3:
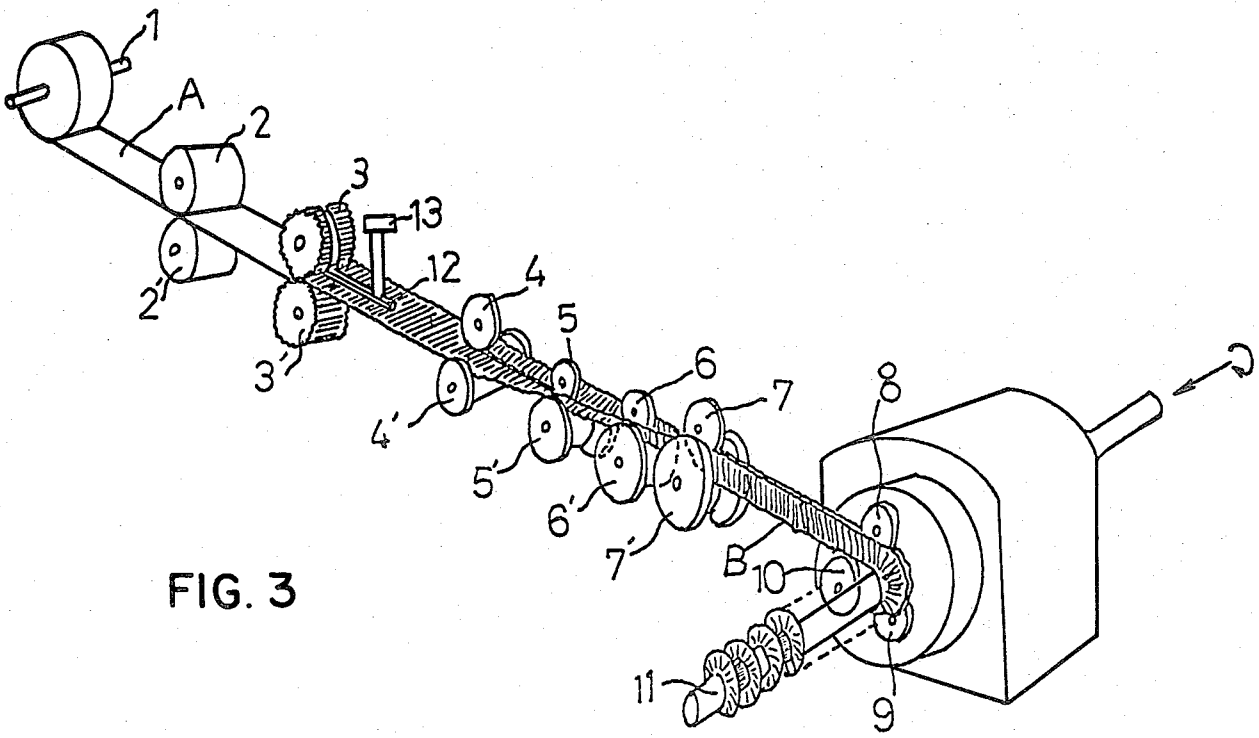
FIG. 3 is a simplified perspective view which explains the fabrication steps of the finned tube of the present invention.
Figure 4A:
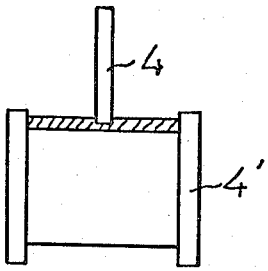
FIGS. 4(*a*) through 4(*d*) are sectional views for the purpose of explanation of the fabrication steps of a fin for use on the finned tube of the present invention.
Figure 4B:
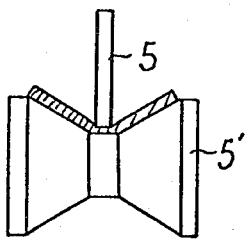
Figure 4C:
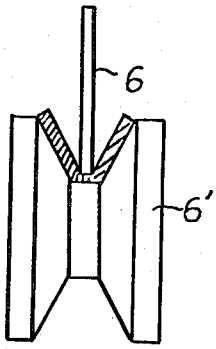
Figure 4D:
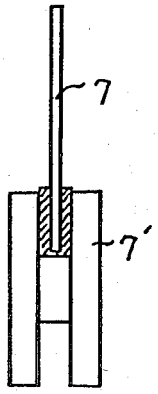
Figure 5A:
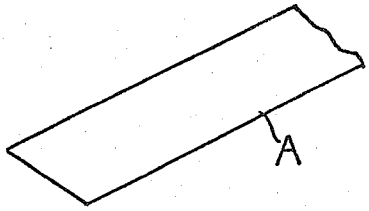
FIGS. 5(*ao*) through 5(*d*) are perspective views showing constructions of the fin during the fabrication steps of FIGS. 4(*a*) through 4(*d*)
Figure 5A:
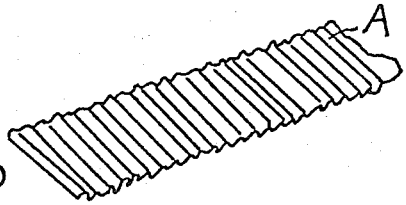
Figure 5A:
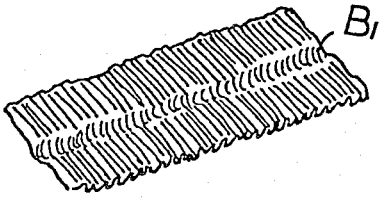
Figure 5B:
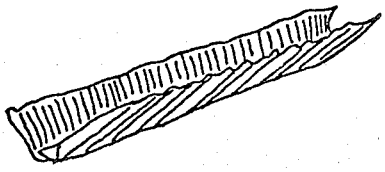
Figure 5C:
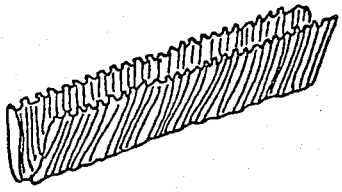
Figure 5D:
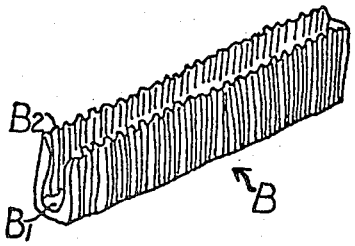

Referring now to FIGS. 3, 4(*a*) through 4(*d*), and 5(*ao*) through 5(*d*), there are illustrated an embodiment for fabricating a finned tube of the present invention and especially for fabricating a fluted fin. A winding 1 of a strip A of heat-radiating material such as aluminum supplies the strip A to a pair of guide rollers 2, 2'. The strip A is corrugated to provide a series of transverse crimps as shown in FIG. 5(*aoo*) when the strip A passes through a pair of geared rollers 3, 3'. The corrugated strip A passes through a pair of rollers 4, 4', the roller 4 being considerably thinner than the roller 4', whereby the middle of the strip A is flattened by virture of the pressure produced by the rollers 4, 4' to form a base B1 as shown in FIG. 5 (*a*). A pair of rollers 5, 5' bend the strip A at the boundary area between the fluted portion and the flattened portion as shown in FIG. 5(*b*) when the strip A passes through the rollers 5, 5'. The roller 5 is as thin as the roller 4, whereas the roller 5' has a small diameter portion of a width slightly thicker than the roller 5 and a diameter increasing portion at the both sides of the small diameter portion, along which the strip A is bent.

The strip A is further bent as shown in FIG. 5(*c*) as it passes through a pair of rollers 6, 6', roller 6 being slightly thinner than the roller 5, the other roller 6' having a taper angle greater than the roller 5'. Consequently, a fluted fin B having a "U" shaped section is formed as shown in FIG. 5(*d*) upon passing through a pair of rollers 7, 7', one roller 7 being thinner than the roller 4, and theother roller 7' having flanges at the both ends thereof.

Figure 6:
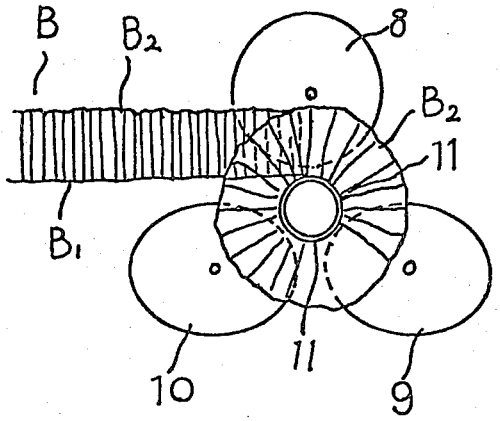
FIG. 6 is a simplified front view which explains the winding operation of the fin on the tubing.
Figure 7:
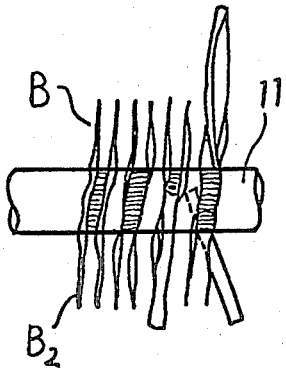
FIG. 7 is a simplified view showing the winding operation of FIG. 6.
Figure 8:
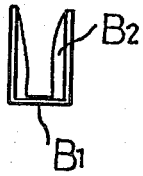
FIG. 8 is a cross sectional view partially showing the fin wound around the tubing.
Figure 9:
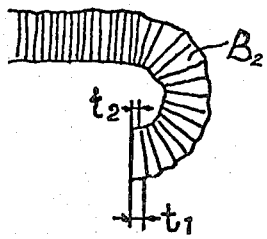
FIG. 9 is a front view explaining the expansion of the crimps provided on the fin during the winding operation.

The fluted end "U" shaped fin A is helically wound around a tube 11, as shown in FIGS. 6 and 7, with the use of a pressure roller 8 and guide rollers 9 and 10, the tube 11 being driven to travel in a longitudinal direction and rotate during the winding operation. The pressure roller 8 has a transverse flutes on the periphery thereof which depress the base $B_1$ of the fin B toward the tube 11. The crimps at the base $B_1$ are flattened by the roller 4 to overlap each other. Therefore the fin B is closely wound around the tube 11. The wave length of the crimps provided on fin portions $B_2$ is shortened to $t_2$ near the base $B_1$ and lengthened to $t_1$ at the periphery of the fin portions $B_2$ by virture of the winding operation to form a sector configuration, thereby facilitating the winding operation and preventing the fin from rupture.

Figure 2:
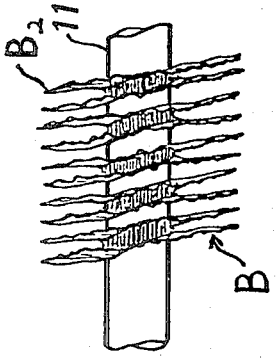
FIG. 2 is a plan view of the finned tube of FIG. 1.
Figure 1:
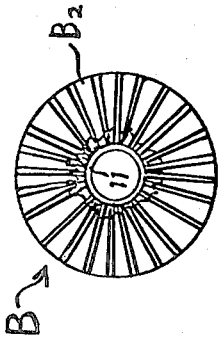
FIG. 1 is a cross sectional view of an embodiment of a finned tube of the present invention.

The finned tube made by the foregoing method has the fin helically wound around the tube 11, the fin having crimps wherein the amplitude is of less magnitude at the periphery of the fin as compared with that near the base $B_1$, as shown in FIGS. 1 and 2. The amplitude of the crimps provided on the fin portions $B_2$ is slightly smaller near the boundary areas between the fin portions and the base $B_1$, since the crimps near the boundary areas are flattened when the base $B_1$ is formed and the strip A is bent to form a "U" shaped fin by the rollers 4, 5, 6 and 7. The reduction of the amplitude of the crimps near the boundary areas between the fin portions $B_2$ and the base $B_1$ is effective to decrease ventilating resistance.

A plate spring 12 is provided for reducing the wave length of the crimps formed by the geared rollers 3, 3'. The wave length of the crimps can be desirably reduced by adjusting an adjusting screw 13 with the use of pressure caused by the plate spring 12 when the wave length of the transverse crimps provided on the strip A is considerably long.

Referring now to FIGS. 10, 11, 12 and 13, there are illustrated an embodiment of a winding machine for fabricating the above-mentioned finned tube, wherein like elements corresponding to those of FIG. 3 are indicated by like numerals. The rollers 2, 2', 3, 3', 4, 4', 5, 5', 6, 6', 7 and 7' are supported by a housing D and the pressure present against the strip A caused by the rollers are adjustable by means of adjusting screws 2A, 2'A through 7A, 7'A which are movable in a vertical direction. The guide rollers 2, 2' are not driven. A bevel gear 14 is associated with a shaft 16 connected to a motor 19 through a bevel gear 15. The shaft 16 is also connected to a gear 18 via a gear 17. The turning force of the motor 19 is supplied to the bevel gear 14 and hence a gear 5'G which is coaxial with the bevel gear 14. The torque of the gear 5'G is transferred to a gear 5G, to gears 4'G and 4G via a gear 20, and to gears 6'G and 6G via a gear 21. The torque of the gear 6'G is transferred to gears 7'G and 7G through a gear 22, whereas the torque of the gear 4'G is transmitted to gears 3'G and 3G through a gear 23. The roller 3 is fixed to the shaft of the gear 3G, the roller 3' is fixed to the shaft of the gear 3'G, and the rollers 4, 4', 5, 5', 6, 6', 7 and 7' are fixed to the shafts of the gears 4G, 4'G, 5G, 5'G, 6G, 6'G, 7G and 7'G, respectively.

The rollers 3, 3' through 7, 7' are driven in the above-mentioned manner, thereby forming the fin B from the strip A. There is provided a groove of a small width along the periphery of the roller 3, through which the plate spring 12 is inserted. One end of the plate spring 12 is fixed to the housing D at the point between the adjacent two rollers 2 and 3, whereas the other end of the plate spring 12 is forced downward by the adjusting screw 13 which is movably fixed in a vertical direction to the housing D at the point between the adjacent two rollers 3 and 4, whereby the wave length of the crimps on the strip A formed by the geared rollers 3, 3' is reduced to a desired length with the use of the adjusting screw 13 and the pressure caused by the plate spring 12.

The tube 11 is driven to travel in a longitudinal direction and rotate around its axis by means of the following mechanism provided within a housing S. The gear 18 is rotatably supported by a bearing 24 fixed to the housing S. A rotor R fixed to the gear 18 is rotatably supported by a bearing 25 within the housing S in such a manner to rotate in unison with the gear 18 in the direction shown by an arrow F. A gear 26 provided at the end of the rotor R is associated with a gear 27, which is coaxial with a gear 28 rotatably supported by a bearing 29 fixed to the housing S. The gear 28 is associated with a gear 30 which has a shaft connected to a bevel gear 31 and rotatably supported by the housing S through a bearing 32. The bevel gear 31 contacts a bevel gear 33 having a shaft fixed to a gear 34 and supported by the housing S through a bearing 35. The gear 34 contacts a gear 36 having a shaft 37 which is supported by the rotor R with the use of an axle-bearing 38 and on which a pair of feeding rollers 39 are mounted. It will be clear that an additional one system for transferring the torque from the gear 36 to the feeding rollers 39 is provided in order to drive the pair of feeding rollers 39. The respective pair of rollers 39 have grooves at the peripheries thereof in which substantially half of the section of the tube 11 is fitted in order to support the tube 11 and feed the tube 11 through the center of the gear 18. The gear 18 and the rotor R is forced to rotate in the direction shown by the arrow F with the revolution of the motor 19. The torque of the rotor R is transmitted to the feeding rollers 39 through the gear 27, the gear 28, the gear 30, the bevel gear 31, the bevel gear 33, the gear 34 and the gear 36. The feeding rollers 39 rotate with respect to the rotor R and also rotate in unison with the rotor R in the direction shown by the arrow F with respect to the housing S, whereby the tube 11 is driven to travel in the direction shown by an arrow G and to rotate in the direction shown by the arrow F. The rollers 8, 9 and 10 are provided on the side wall of the housing S with the use of fixed arms 8A, 9A and 10A, and supporting arms 8'A, 9'A and 10'A. The rollers 8, 9 and 10 are adjustable in the longitudinal and the radial directions of the tube 11 with the use of the supporting arms 8'A, 9'A and 10'A, thereby ensuring the close winding of the fluted fin B to the tube 11.

Figure 10:
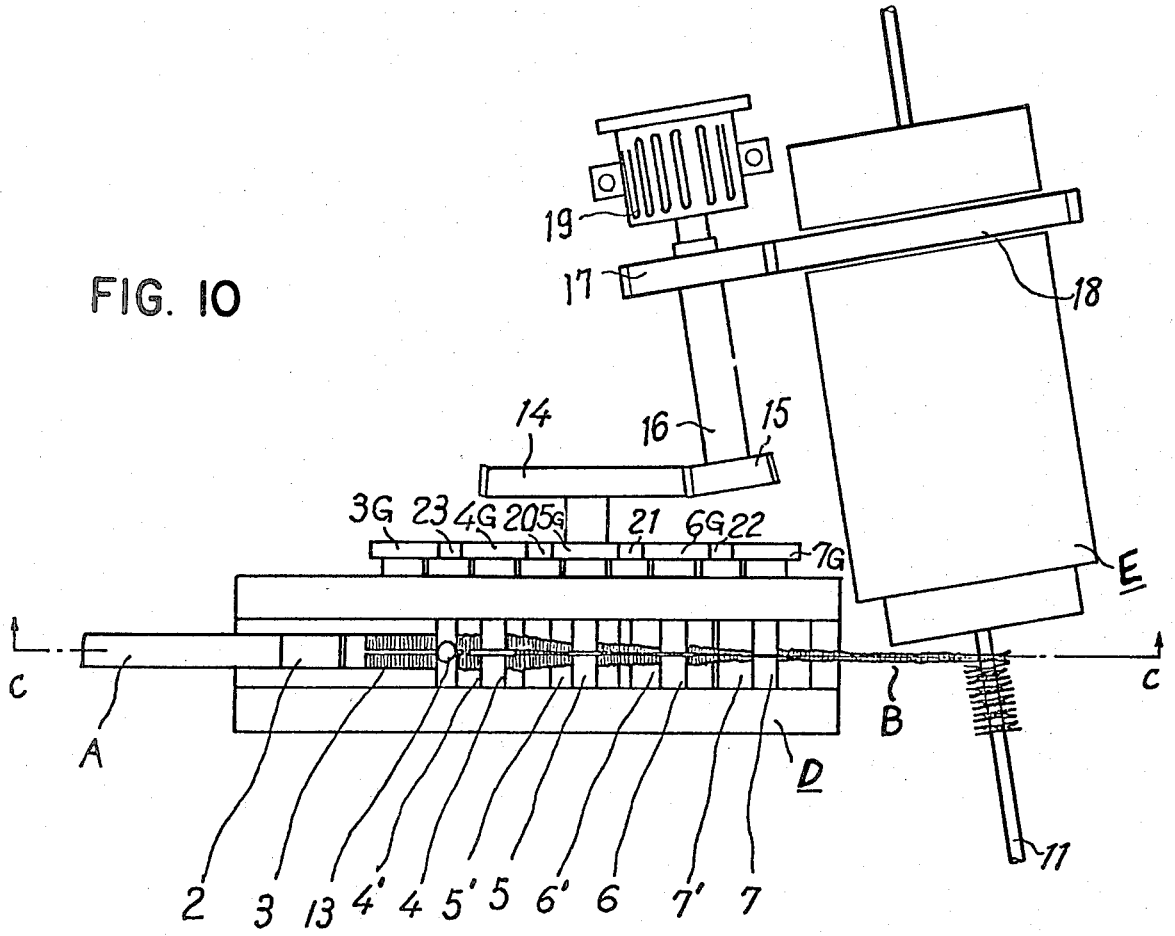
FIG. 10 is a plan view of a winding machine producing the finned tube of the present invention.
Figure 11:
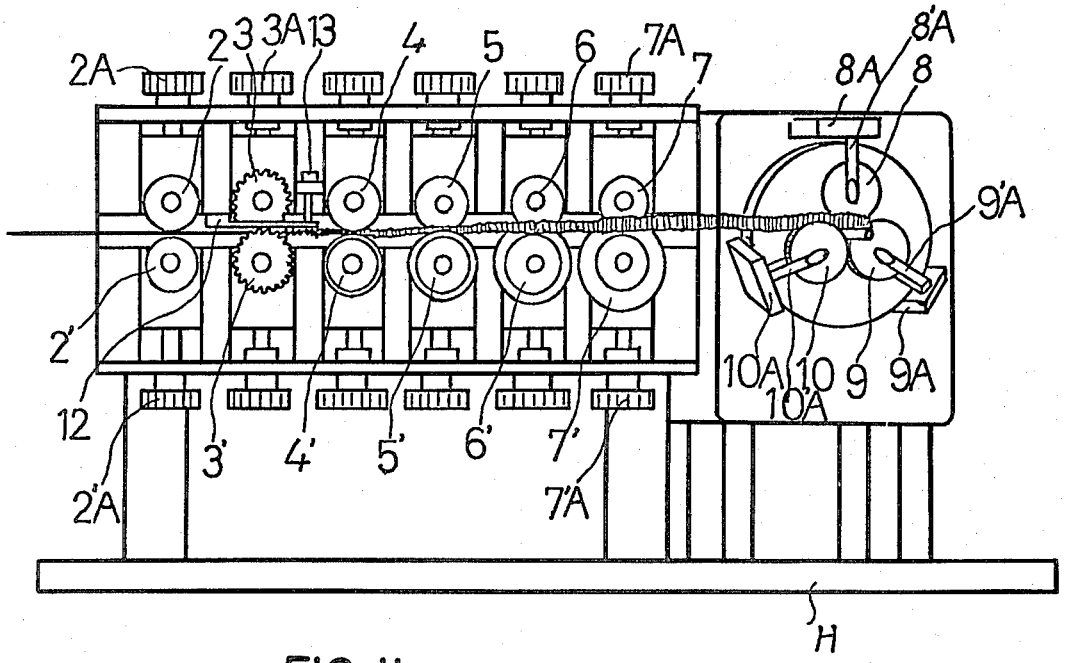
FIG. 11 is a sectional view as seen at C—C of FIG. 10.
Figure 12:
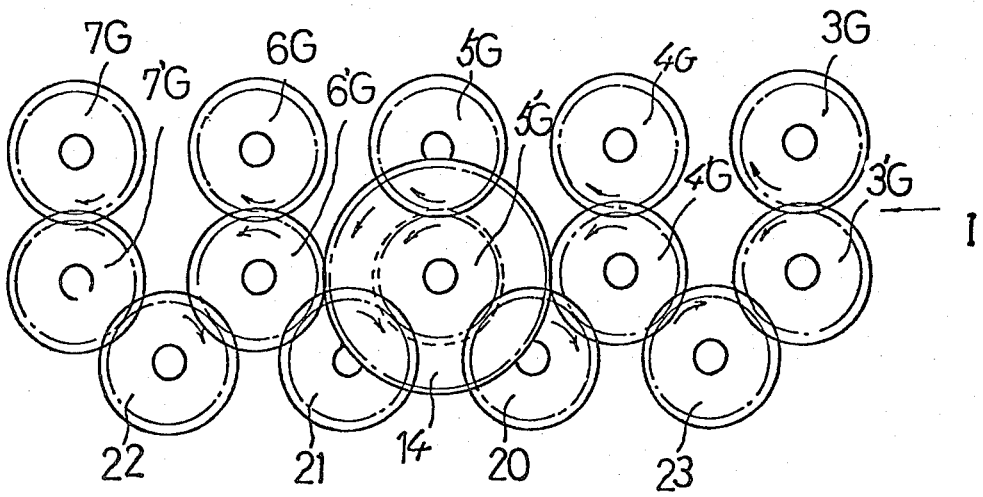
FIG. 12 is a front view showing the power transferring system of the machine of FIG. 10.
Figure 13:
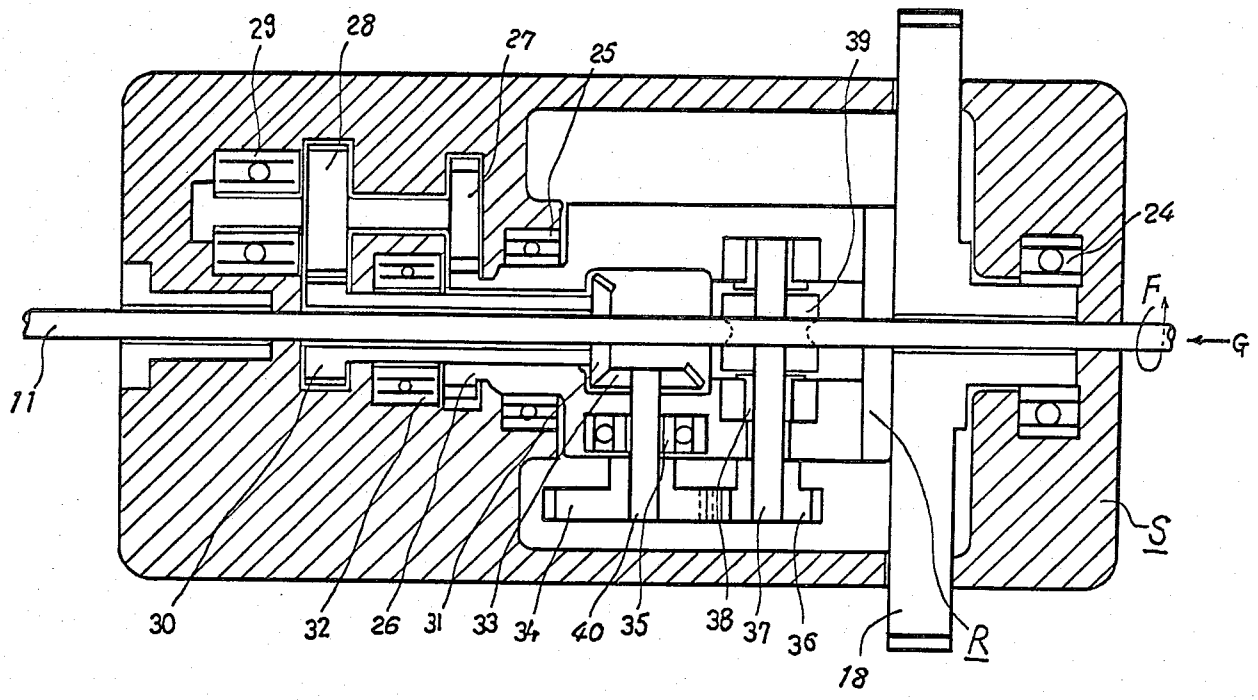
FIG. 13 is a cross sectional view of the tube driving system of the machine of FIG. 10.

The housing S and the housing D are fixed to a table H in such a manner that the tube 11 is inclined a predetermined small angle with respect to the perpendicular to the fluted fin B supplied to the pressure roller 8, as shown in FIG. 10. In FIG. 10, the pressure roller 8, the guide rollers 9 and 10, the fixed arms 8A, 9A and 10A, and the supporting arms 8'A, 9'A and 10'A are omitted for the purpose of simplicity. At first the end of the fluted fin B is fixed to the tube 11 with the use of either the brazing technology or the adherent technology, and the fluted fin B is helically wound around the tube 11 by contacting the base $B_1$ to the tube 11 upon the feeding of the fluted fin B toward the tube 11, and rotating and advancing the tube 11. A cover E is provided for covering the housing S. In the foregoing winding machine, the tube 11 is rotated and advanced during the winding operation. It will be noted that the same winding operation can be accomplished by rotating the tube 11 and moving the housing D, which forms the fluted fin, in the longitudinal direction of tube 11, or traveling the tube 11 in its longitudinal direction and rotating the housing D around the tube 11.

Figure 14:
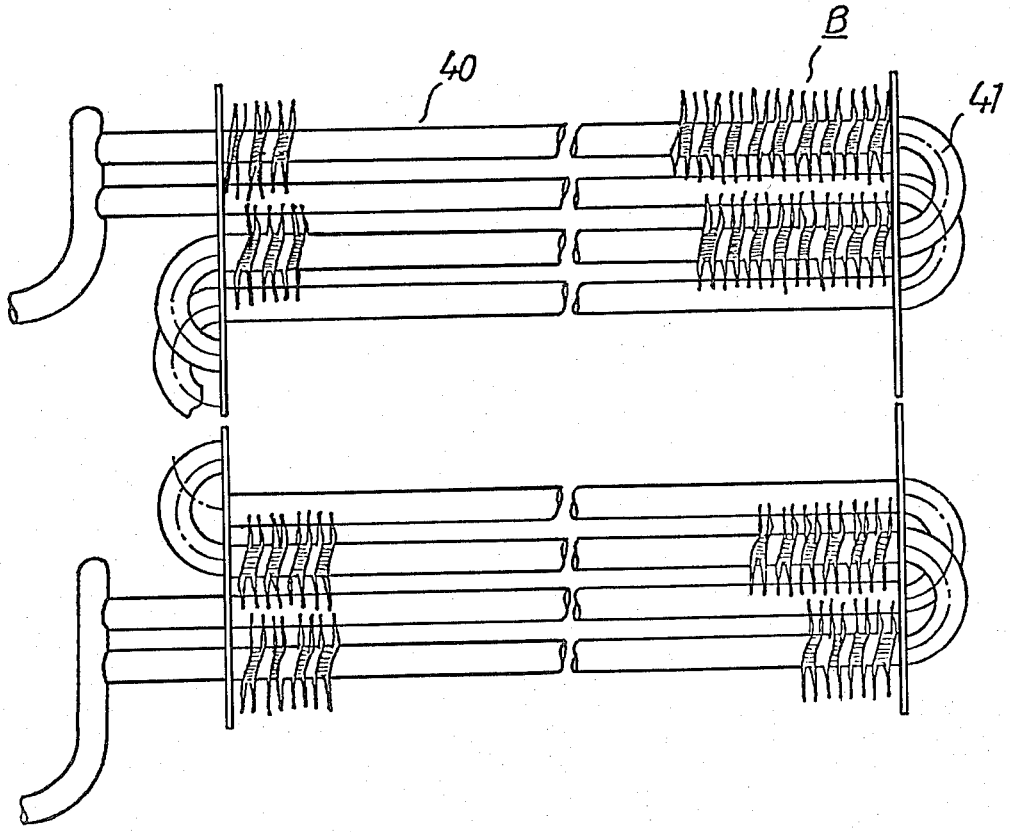
FIG. 14 is a front view showing an embodiment of a heat exchanger employing the finned tube of the present invention.

The finned tube of the present invention is bent in a serpentine fashion with the use of a suitable bending means to form a heat exchanger as shown in FIG. 14. The fluted fin B should not be wound around the tube 11 at a bending portion 41 in order to facilitate the winding operation. But the bending portion 41 can be wound by the fluted fin B when the bending means is so constructed so as not to rupture the fluted fin B, since the fluted fin B of the present invention is very rigid when compared with the fluted fin of the prior art.

Figure 15:
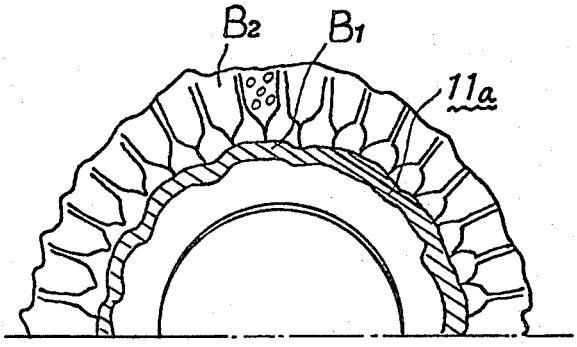
FIG. 15 is a cross sectional view of another embodimet of a finned tube of the present invention.

FIG. 15 shows another embodiment of the present invention, wherein the base $B_1$ of the fin B is caused to bite the periphery of the tube 11 during the winding operation in order to tightly cling to the tube 11 and increase the heat transfer coefficient.

Figure 16:
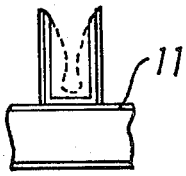
FIG. 16 is a longitudinal section of the finned tube of still another embodiment of the present invention.
Figure 17:
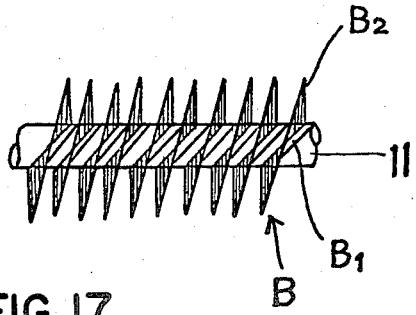
FIG. 17 is a plan view showing still further another embodiment of the finned tube of the present invention.

The crimps on the fin portion $B_2$ can be flattened as shown in FIG. 16 when it is desired to reduce the ventilating resistance. A plurality of holes can be provided on the fin portion $B_2$ in order to increase the heat transfer coefficient and reduce the ventilating resistance.

When the base $B_1$ is provided at one edge of the strip A, the section of the fluted fin B is "L" shaped. A method for fabricating the "L" shaped fin is very similar to that of fabricating the above-mentioned "U" shaped fin and, therefore, the method for fabricating the "L" shaped fin is omitted from the description for the purpose of simplicity.

The invention being thus described, it will be obvious that the same way be varied in many ways. Such variations are not regarded as a departure from the spirit and scope of the invention, and all such modifications are intended to be included within the scope of the following claims.

What is claimed is:

1. A finned tube useful for heat exchangers comprising:

a hollow tube;

a "U" shaped fin made of a heat-radiating material and helically wound around said hollow tube;

a plurality of radially extending corrugated crimps formed on the fin portion of the "U" shaped fin; and a base formed by flattening the crimps provided on the bottom of the "U" shaped fin, the base being forced into contact with the periphery of the tube.

2. The finned tube of claim 1 wherein the amplitude of the crimps near the bottom of the fin portion is reduced, thereby reducing ventilating resistancce.

3. The finned tube of claim 1, wherein the wave length of the crimps provided on the finned portions is shortened near the base and lengthened at the periphery of the fin to form a sector configuration, thereby facilitating the winding operation and preventing the fin from rupturing.

4. The finned tube of claim 1, wherein the amplitude of the crimps is of less magnitude at the periphery of the fin as compared with the base of the fin.

5. The finned tube of claim 1, wherein the amplitude of the crimps provided on the finned portion is slightly smaller near the boundary areas between the finned portions and the base, the reduction of said amplitude of the crimps near said boundary areas being effective to decrease ventilating resistance.

6. The finned tube of claim 1, wherein the base of the fin is caused to bite into the periphery of the tube during the winding operation, thereby increasing the overall heat transfer coefficient of the tube.

7. The finned tube of claim 1, wherein the corrugated crimps are flattened to reduce the ventilating resistance.

8. The finned tube of claim 7, wherein a plurality of holes are provided in the fin portion in order to increase the heat transfer coefficient and reduce the ventilating resistance.

* * * * *